United States Patent [19]

Kolvites

[11] Patent Number: 4,773,681

[45] Date of Patent: Sep. 27, 1988

[54] LATCH MECHANISM

[75] Inventor: Albert Kolvites, Mountaintop, Pa.

[73] Assignee: InterMetro Industries Corporation, Wilkes-Barre, Pa.

[21] Appl. No.: 5,840

[22] Filed: Jan. 21, 1987

[51] Int. Cl.[4] ..... E05C 3/22

[52] U.S. Cl. ..... 272/86; 292/DIG. 72; 292/336.3

[58] Field of Search ..... 292/DIG. 14, DIG. 72, 292/86, 336.3, 174

[56] References Cited

U.S. PATENT DOCUMENTS

| | | | |
|---|---|---|---|
| 853,860 | 5/1907 | Bigelow | 292/80 |
| 956,329 | 4/1910 | Foster | 292/259 X |
| 1,700,747 | 2/1929 | Roedding et al. | 292/DIG. 72 X |
| 1,830,786 | 11/1931 | Ferris . | |
| 2,061,493 | 11/1936 | Tracy . | |
| 2,087,143 | 7/1937 | Geske et al. . | |
| 2,175,124 | 10/1939 | Kulhanek | 292/86 X |
| 2,559,736 | 7/1951 | Scarborough . | |
| 2,766,059 | 10/1956 | Michalsky | 292/336.3 |
| 3,737,184 | 6/1973 | Swartz . | |
| 4,109,950 | 8/1978 | Amdal . | |
| 4,210,350 | 7/1980 | Lysenko et al. | 292/86 |

*Primary Examiner*—Richard E. Moore

*Attorney, Agent, or Firm*—Fitzpatrick, Cella, Harper & Scinto

[57] ABSTRACT

A latch mechanism for an insulated cabinet, having a cabinet door and a cabinet housing, includes a striker disposed on the housing and a slotted striker plate disposed on the cabinet door for receiving the striker. A latch spring is disposed within the cabinet door adjacent the slotted striker plate such that the slotted striker plate receives the striker and the latch spring releasably secures the striker. A latch rod assembly is adapted to cooperate with the latch spring to enable release of the striker and this assembly includes a latch rod having an operating handle and a lifter rod portion linked with the latch spring to lift the spring to release the striker. The assembly further includes a latch rod guide for supporting and guiding the latch rod for reciprocal movement.

7 Claims, 2 Drawing Sheets

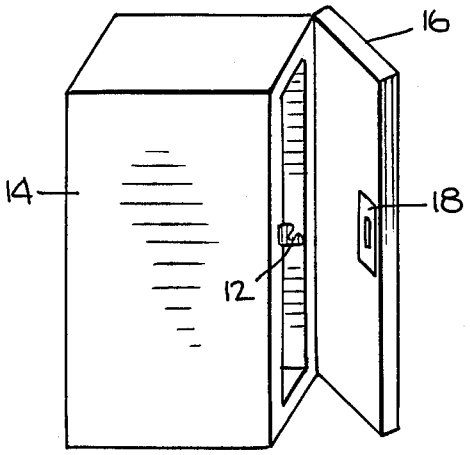
Fig. 1.
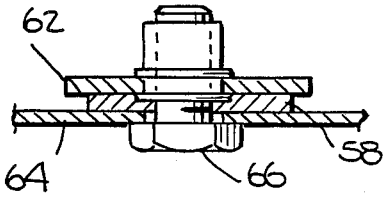
Fig. 7.
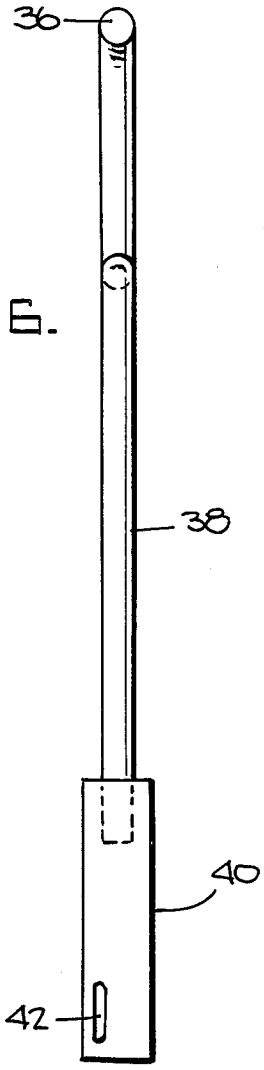
Fig. 6.
Fig. 2.
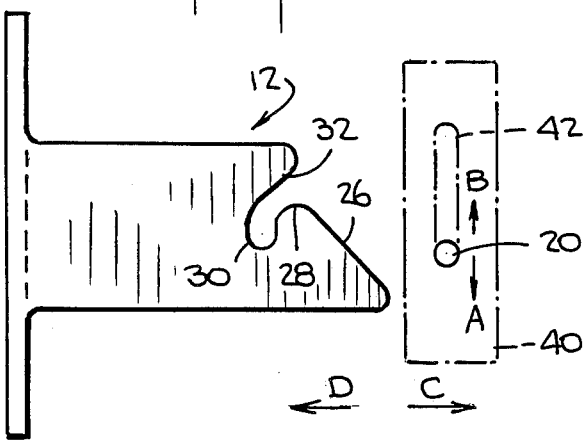

LATCH MECHANISM

BACKGROUND OF THE INVENTION

1. Field of the Invention

The present invention relates generally to a latch mechanism, and more particularly to a latch mechanism for securing the door of a cabinet such as a heated cabinet used in the food service industry.

2. Description of the Prior Art

Heated cabinets are well known in the food service industry. Although in some instances, such heated cabinets may be used for cooking food, in many instances they are used for maintaining cooked foods at an elevated temperature prior to food service.

Because of the opportunity for contamination of food contained therein, it is essential that such cabinets be easy to clean and maintain free of contaminants. More specifically, it is essential that each component of the cabinet be easy to clean and maintain. One especially undesirable source of contamination is that from insects and other vermin. It is therefore a requirement that each component be designed to prevent insects and other vermin from entering the cabinet. Still further, it is desirable that each component be simple in design and operation, and inexpensive to manufacture.

Numerous cabinet latch designs are known in the prior art. However, known latch designs for cabinets of the class described generally suffer from at least one of the following drawbacks: difficulty in cleaning or maintaining clean, failure to adequately prevent insects and other vermin from entering the cabinet, complexity of design, complexity of operation, or high manufacturing costs. Therefore, a need exists for an improved latch for such a cabinet, having a simple, inexpensive design which is easy to clean and effectively precludes insects and other vermin from entering the heated cabinet.

SUMMARY OF THE INVENTION

It is therefore an object of the present invention to provide a latch mechanism which is an improvement over latch mechanisms known in the prior art.

More specifically, it is an object of the present invention to provide an improved latch mechanism for a cabinet used in the food service industry, the latch mechanism having a simple, inexpensive design that is easy to operate, easy to clean, and effectively precludes insects and other vermin from entering the cabinet.

A preferred embodiment of the present invention generally comprises a striker disposed on the cabinet housing, a slotted striker plate disposed on the cabinet door for receiving the striker, a coiled latch spring having an extended arm and disposed in a latch spring housing, the latch spring housing and latch spring being disposed immediately adjacent the slotted striker plate in the cabinet door, and a latch rod having a handle portion and a lifter portion, the lifter portion coorperating with the extended arm of the latch spring, wherein when the slotted striker plate receives the striker, the striker releasably engages the coiled latch spring arm, the striker being releasable by operation of the latch rod.

A more complete appreciation of the present invention and a more complete understanding of these and other objects, aspects and features of the present invention will be provided in the following detailed description when considered in conjunction with the accompanying drawing.

BRIEF DESCRIPTION OF THE DRAWING

FIG. 1 is a perspective view of a cabinet having the latch mechanism of the present invention;

FIG. 2 illustrates in detail a striker together with a coiled latch spring mechanism of the preferred embodiment;

FIG. 6 is a side view of the latch rod shown in FIG. 4; and

FIG. 7 is a cross-sectional view taken along line 7—7 of FIG. 5, illustrating a wiper mounting assembly.

DETAILED DESCRIPTION OF A PREFERRED EMBODIMENT

Figure 5:
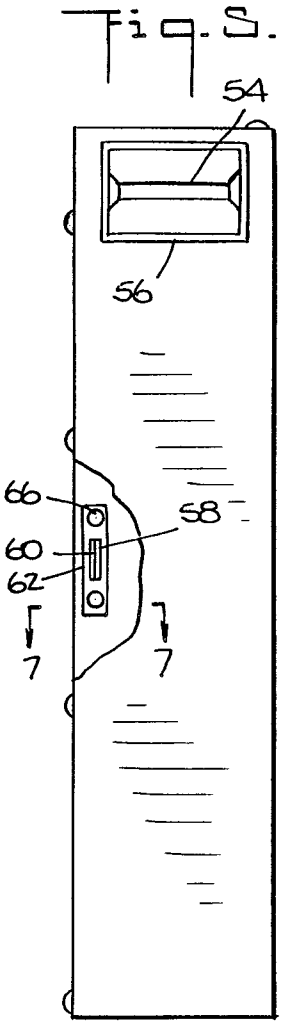
FIG. 5 is a partial front elevational view showing part of the outer side of the cabinet door again bounded by the dotted line in FIG. 3 and partially broken away to show internal structure.

Referring now to the drawing, FIGS. 1 through 7 illustrate a preferred embodiment of the present invention. FIG. 1 is a perspective view of a cabinet 10 having a latch mechanism of the present invention. A striker 12 is mounted on the cabinet housing 14 and the remainder of the latch mechanism is contained in a cabinet door 16 behind a slotted striker plate 18. It will be appreciated that when the cabinet door 16 is closed, the slot in the striker plate 18 receives the striker 12, such that the striker 12 engages and shifts a spring arm 20 constituting part of the latch mechanism, all for a purpose to be described in detail below.

As shown in FIG. 2, the striker 12 is formed to include a first inclined strike surface 26, an apex 28, a latching notch 30, and a second inclined strike surface 32.

Figure 4:
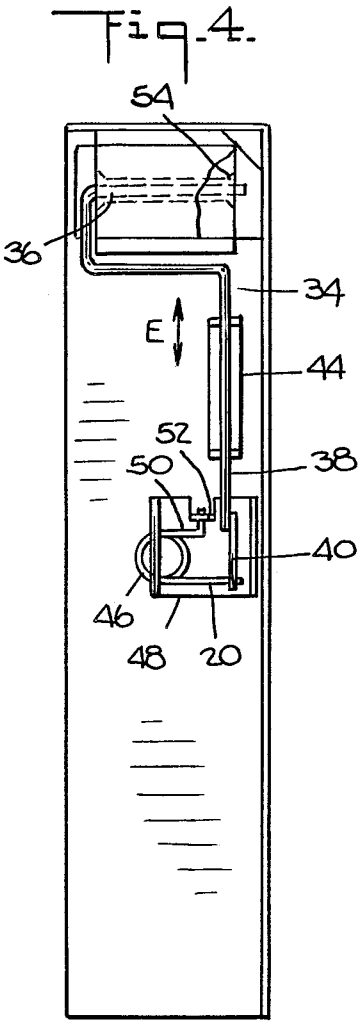
FIG. 4 is a partial rear elevational view showng the part of the inner side of the cabinet door bounded by the dotted line in FIG. 3, and further partially broken away to illustrate the internal structure of the mechanism of the preferred embodiment.
Figure 3:
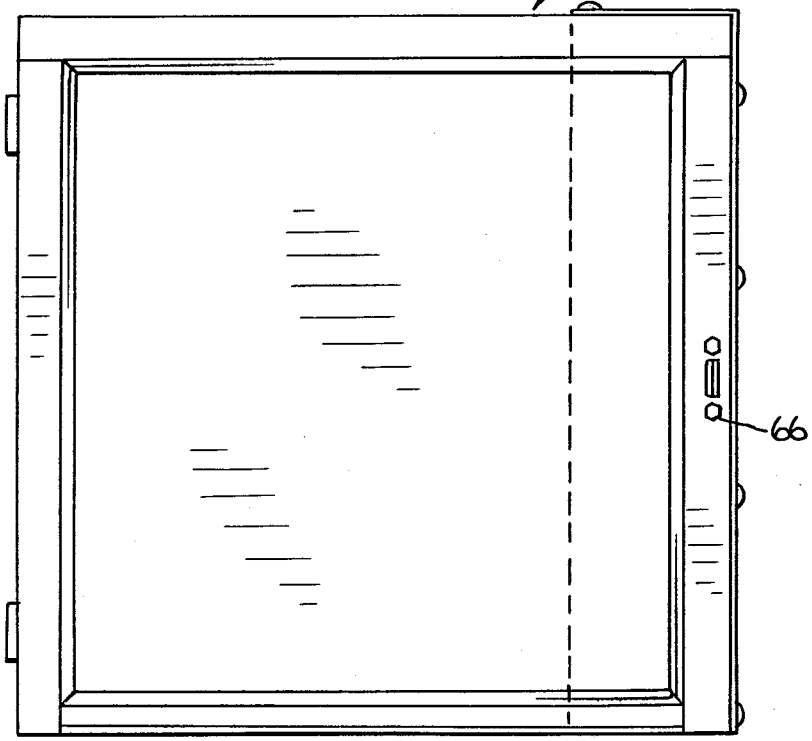
FIG. 3 is an rear elevational view of the inner side of the cabinet door shown in FIG. 1.

As shown in FIG. 4, the latch apparatus includes a latch rod 34, a latch rod guide 44, a coiled latch spring 46 and a latch spring housing 48.

The latch rod 34 includes an operating handle 36 and a lifter portion 38 which terminates in a tab 40. The tab 40 may be formed integrally with the latch rod 34 or, alternatively, it may be affixed thereon by conventional means. In the preferred embodiment, a separate metal rod 34 and tab 40 preferably formed of stainless or coated steel, are welded together. Further, as shown in FIG. 6, the tab 40 is provided with an elongated vertical slot 42.

The latch rod 34 is slideably supported for reciprocal movement in the direction of two-way arrow E by the latch rod guide 44.

The handle 36 of the latch rod 34 is fitted with a flexible sleeve 54, preferably formed of rubber and disposed within a recess 56 in the exterior of the cabinet door (see FIG. 5). The flexible sleeve 54 is further fitted to the perimeter of recess 56, so that the latch mechanism is sealed against contamination from the exterior.

The coiled latch spring 46, has a latch spring foot 50 and a latch spring arm 20 and is disposed within the latch spring housing 48, so that the latch spring foot 50 is biased against a housing tab 52, and the latch spring arm 20 extends through tab slot 42 of tab 40. In the preferred embodiment, the coiled spring comprises three turns, and is composed of a rolled stainless steel wire, e.g. #11 (0.120) D1A stainless steel wire.

FIG. 7 illustrates in cross section the slotted striker plate assembly of the preferred embodiment. As shown in FIGS. 5 and 7, a striker wiper 58 composed of a flexible material such as rubber and having a wiper slit 60, is sandwiched between a backing member 62 and the cabinet door wall 64. The assembly is affixed therefore together by a pair of conventional nut and bolt assemblies 66.

In operation, when closing the cabinet door, by pivoting it about hinge pins 11 (FIG. 3), the striker fixed to the cabinet and latch spring assembly of components mounted in the door 12 move relative to one another in the direction of arrow C (FIG. 2) so that the striker passes into the wiper slit 60, is wiped by the wiper 58, and engages the latch spring arm 20 which is cammed upwardly, as viewed, by the inclined surface 26 of the striker 12, in cooperation with the tab slot 42 (see arrow B FIG. 2). The coiled latch spring arm 20 is spring biased in the direction of arrow A. When the spring arm 20 reaches the apex 28, it will drop, with the aid of the spring bias, in the direction of arrow A, into latch notch 30. It will be further appreciated that because the coiled latch spring arm 20 is free to traverse the tab slot 42, the latch rod 34 is not lifted and no force or energy is required for that purpose when closing the cabinet door. Rather the minimal energy required to close the latch apparatus is the energy required to overcome the spring bias.

To open the cabinet door, the handle portion 36 of latch rod 34 is manually lifted. As the latch rod 34 is lifted, the coiled latch spring arm 20, which is biased against the base of the tab slot 42, is lifted out of latch notch 30 and against the second angled striker surface 32. This action cams striker 12 in the direction of arrow D (FIG. 2), and thus opens the cabinet door.

In addition to the above operational features, it will be appreciated that the striker wiper functions as a squeegy to clean the striker 12 each time the cabinet door is opened or closed. Further, when the door is open, the narrow slit of flexible striker wiper 58 effectively seals the latch apparatus from contamination from insects and other vermin.

Although specific embodiments of the present invention have been described above in detail, it will be understood that this description is for purposes of understanding. Modification of the preferred embodiments described herein may be made by those skilled in the art without departing from the scope of the present invention which is set forth in the following claims.

What is claimed is:

1. A latch mechanism for latching together a cabinet door and a cabinet housing to which the cabinet door is mounted for opening and closing movement, said latch mechanism comprising:

a striker mounted with one of a housing and the cabinet door;

a slotted striker plate mounted with the other of the housing and the cabinet door;

a latch spring mounted with the other of the housing and the cabinet door adjacent said striker plate, said latch spring being mounted for reciprocal movement between a latched position for capturing said striker and an unlatched position for releasing said striker; and latch rod assembly means for moving said latch spring from the latched position to the unlatched position, said assembly means including a latch rod having an operating handle and a lifter rod portion linked to said latch spring, and a latch rod guide for supporting and guiding said latch rod for reciprocal movement by manipulation of said operating handle, whereby reciprocal movement of said latch rod in one direction moves said latch spring to the unlatched position.

2. A latch mechanism according to claim 1, further comprising a, latch housing having a stop, in which said latch spring is mounted; wherein said latch spring is a coil spring having one end biased toward said stop of said latch spring housing thereby toward the latched position, and having another end formed with an extended arm secured to said latch spring housing; and whrein said lifter rod portion includes a slotted tab for receiving said one end of said coiled latch spring to link said latch spring to said latch rod.

3. A latch mechanism according to claim 2, wherein said handle is disposed for access outside the other of the housing and the cabinet door and is fitted with a flexible sleeve for sealing the latch mechanism against contamination from the exterior of the other of the housing and the cabinet door.

4. A latch mechanism according to claim 2, wherein said striker has an inclined surface formed for camming said one end of said coil spring toward the unlatched position in which it is releasably engaged by said striker when the housing and the cabinet door are moved to the closed position.

5. A latch mechanism according to claim 4, wherein said striker has a notch for receiving and releasably securing said one end of said coil spring after it has been cammed by said inclined surface.

6. A latch mechanism according to claim 5, wherein said striker has a second inclined surface formed to engage said one end of said coil spring to cam said striker out of said slotted striker plate when said one end is lifted by said lifter rod.

7. A latch mechanism according to any one of claims 1, and 2 through 6, further comprising slotted wiper means adapted to wipe said striker as it passes said striker plate.

* * * * *

UNITED STATES PATENT AND TRADEMARK OFFICE

CERTIFICATE OF CORRECTION

PATENT NO. : 4,773,681

DATED : September 27, 1988

INVENTOR(S) : ALBERT KOLVITES

It is certified that error appears in the above-identified patent and that said Letters Patent is hereby corrected as shown below:

COLUMN 1

Line 59, "coorperat-" should read --cooperat- --.

COLUMN 2

Line 10, "an" should read --a--.
Line 12, "showng" should read --showing--.

COLUMN 3

Line 38, "angled" should read --inclined--.
Line 43, "squeegy" should read --squeegee--.

COLUMN 4

Line 24, "a, latch" should read --a latch--.
Line 30, "whrein" should read --wherein--.

Signed and Sealed this

Eleventh Day of April, 1989

*Attest:*

DONALD J. QUIGG

*Attesting Officer*

*Commissioner of Patents and Trademarks*